US005821959A

United States Patent [19]

Murakami et al.

[11] Patent Number: 5,821,959

[45] Date of Patent: Oct. 13, 1998

[54] ORIFICE PLATE, METHOD OF PRODUCTION OF ORIFICE PLATE, LIQUID MIXING APPARATUS, AND PRINTER APPARATUS

[75] Inventors: Takaaki Murakami; Koichiro Kishima, both of Kanagawa; Makoto Ando; Tetsuo Nakayama, both of Tokyo, all of Japan

[73] Assignee: Sony Corporation, Tokyo, Japan

[21] Appl. No.: 621,619

[22] Filed: Mar. 26, 1996

[30] Foreign Application Priority Data

Mar. 28, 1995 [JP] Japan ..... 7-069459

[51] Int. Cl.[6] ..... B41J 2/14

[52] U.S. Cl. ..... 347/47

[58] Field of Search ..... 347/9, 20, 40, 347/44, 47, 62, 65, 68, 72

[56] References Cited

U.S. PATENT DOCUMENTS 5,198,834 3/1993 Childers et al. ..... 347/65

5,402,159 3/1995 Takahashi et al. ..... 347/9

5,600,356 2/1997 Sekiya et al. ..... 347/62

5,640,184 6/1997 Moynihan et al. ..... 347/47

5,659,346 8/1997 Moynihan et al. ..... 347/68

*Primary Examiner*—Adolf Berhane

*Attorney, Agent, or Firm*—Hill & Simpson

[57] ABSTRACT

An orifice plate wherein a plurality of supply ports to which two or more types of different liquids are supplied are disposed on one surface of a laminated plate comprising three plates laminated to each other and a nozzle for discharging a liquid mixture obtained by mixing two or more types of liquids is disposed on the other surface opposite to the surface on which these plurality of supply ports are disposed, wherein the plate disposed at the intermediate level is made of a photosensitive resin and has a flow path formed in the direction inside the surface of this plate.

15 Claims, 10 Drawing Sheets

ORIFICE PLATE, METHOD OF PRODUCTION OF ORIFICE PLATE, LIQUID MIXING APPARATUS, AND PRINTER APPARATUS

BACKGROUND OF THE INVENTION

1. Field of the Invention

The present invention relates to an orifice plate used for a printer performing a printing on paper, for example, a method of production of the orifice plate, a liquid mixing apparatus using this orifice plate, and a printer apparatus using this orifice plate, more particularly relates to the structure of the orifice plate.

2. Description of the Related Art

Conventionally, as a so-called on-demand type printer apparatus, there is a printer in which ink droplets are discharged from a nozzle in accordance with a recording signal so as to record on a recording medium such as paper or film. This enables a reduction of size and lowering of cost, so has been rapidly spreading in use in recent years.

On the other hand, in recent years, particularly in offices, documents are being frequently being prepared using computers in what is referred to as desk top publishing. Further, recently, there has been a growing demand for outputting not only characters and graphics, but also color natural images such as photographs together with the characters and figures. In order to print a high quality natural image in this way, the reproduction of the halftones is important.

In this on-demand type printer apparatus, the ink droplets are generally discharged by a method using for example a piezoelectric element or a method using a heat generating element. The method of using a piezoelectric element is a method in which pressure is given to the ink by the deformation of the piezoelectric element to cause the ink to be discharged from the nozzle. On the other hand, the method of using the heat generating element is a method in which the ink is heated and made to boil by the heat generating element to cause the ink to be discharged by the pressure of the generated bubbles.

To reproduce halftones, there are the method of changing the voltage and pulse width given to the piezoelectric element or the heat generating element to control the size of the discharged liquid droplet and thereby make the diameter of the printing dots variable to express the gradations and the method of comprising a pixel by a matrix consisting of for example 4×4 dots without changing the dot diameter and expressing the gradations in units of this matrix by using the so-called dither method.

In the on-demand type printer apparatus, however, as mentioned above, in the method of changing the voltage or pulse width to be given to the piezoelectric element or the heat generating element, when the voltage or pulse width given to the piezoelectric element or the heat generating element is made too low, the ink can no longer be discharged, so there is a limit to the smallest liquid droplet diameter, the number of gradations which can be expressed is small, and, particularly, it is not possible to express a low density. Accordingly, this method was insufficient in practice for printing out natural images.

Further, in the method of expressing tones by the dither method, when for example comprising one pixel by a 4×4 matrix, 17 gradations of density can be expressed. Where the printing is carried out with for example the same dot density as that for the first method, however, the resolution is deteriorated to one-quarter of it and the roughness is conspicuous, so this method was also insufficient in practice for printing out a natural image.

To overcome the problems in the above conventional methods, the assignee of the present application has previously proposed a printer apparatus which prints out a natural image without causing a deterioration of the resolution while enabling the control of the density of the ink of the liquid droplets discharged in a printer system of a so-called on-demand type, that is, the density of the dot to be printed.

The structure of the nozzle portion, that is, the orifice plate, used in the on-demand type printer apparatus was previously proposed in JP Serial No. 5-321246 and will be explained later along with the process of production of the same with reference to the drawings.

This orifice plate, however, had to be produced by sputtering or evaporation. That is, the orifice plate could not be prepared only by a plating process, and an expensive device such as a sputtering device was required.

Further, where the orifice plate was produced by using a vacuum evaporation device, Ni particles sometimes flew from the evaporation source 426 and adhered to portions other than the portions to which they were originally supposed to be deposited. It was difficult to chemically remove this, so use had to be made of a mechanical method such as polishing, which caused a reduction of the manufacturing yield of the orifice plate.

When trying to prevent this problem from occurring in advance, there arise the problems of enlargement of the size of the vacuum evaporation device, that is, the equipment becomes expensive, or of the reduction of size of the orifice plate to be prepared, that is, the enlargement of the aperture (lowering of cost), becoming impossible.

OBJECT AND SUMMARY OF THE INVENTION

The present invention was proposed in consideration of the above problems and has as an object to provide an orifice plate and a method for production thereof which improve the manufacturing yield of the orifice plate and, at the same time, enable the enlargement of the apertures and realize lower costs.

Another object of the present invention is to provide a liquid mixing apparatus and a printer apparatus using this orifice plate which have a high reliability and yet are inexpensive.

In the orifice plate according to the present invention, so as to achieve the above object, a plate disposed at an intermediate position in a laminated plate formed by the lamination of three plates is made of a photosensitive resin. In this intermediate plate made of the photosensitive resin, a flow path is formed in the in-plane direction of the plate.

The flow path formed in this intermediate plate is connected to the supply ports disposed in the orifice plate and, at the same time, connected to the nozzle. Further, at least one supply port among a plurality of supply ports is disposed at a position opposite to the nozzle.

One or more types among the two or more types of liquids to be supplied to the supply ports of this orifice plate is made the ink. Further, one or more types among the two or more types of liquids is made the ink and the other one or more types of liquids is made a dilution liquid, for example, a transparent solvent.

In the method of production of this orifice plate according to the present invention, a third plate disposed at the intermediate position is laminated by being sandwiched from the thickness direction in by a first plate in which the supply ports are formed and a second plate in which the nozzle is formed.

The liquid mixing apparatus of the present invention uses this orifice plate so that a liquid vessel in which the liquid is filled is connected to the supply ports and, at the same time, a liquid mixture vessel accommodating the liquid mixture obtained by mixing two or more types of liquids is connected to the nozzle.

On the other hand, a printer apparatus according to the present invention uses this laminated plate as well to dispose in the vicinity of the supply ports a pressure raising means for raising the pressure of the liquid in the vicinity of the supply ports. The pressure of the liquid in the vicinity of the supply ports is raised by this pressure raising means so as to discharge the liquid mixture obtained by this mixing from the nozzle and deposit it on the recording medium.

As the pressure raising means, a heater or a piezoelectric element is used. As the piezoelectric element, for example, a known piezoelectric element can be used.

According to the present invention, since the plate disposed at the intermediate position among the laminated plates is made of a photosensitive resin, an orifice plate having a good manufacturing yield and in addition having a large aperture and high reliability can be easily obtained without using a vacuum thin film forming apparatus by merely adhering the plate on which the supply ports are formed and a plate on which the nozzle is formed to the upper and lower surfaces of this photosensitive resin.

Further, by using this orifice plate, which is inexpensive and has a high reliability, in a liquid mixing apparatus, a reduction of the cost of the liquid mixing apparatus itself can be expected.

Similarly, by using this inexpensive orifice plate in a printer apparatus, a reduction of the cost of the printer apparatus itself can be expected.

BRIEF DESCRIPTION OF THE DRAWINGS

These and other objects and features of the invention will become more apparent from the following detailed description of the related art and preferred embodiments made with reference to the accompanying figures, in which.

DETAILED DESCRIPTION OF THE PREFERRED EMBODIMENTS

Before entering the detailed description of the preferred embodiments, a more detailed explanation will be given of the related art, with reference to the drawings, for background purposes.

As explained above, to overcome the problems in the above conventional methods, the assignee of the present application previously proposed a printer apparatus which prints out a natural image without causing a deterioration of the resolution while enabling the control of the density of the ink of the liquid droplets discharged in a printer system of a so-called on-demand type, that is, the density of the dot to be printed.

Figure 1:
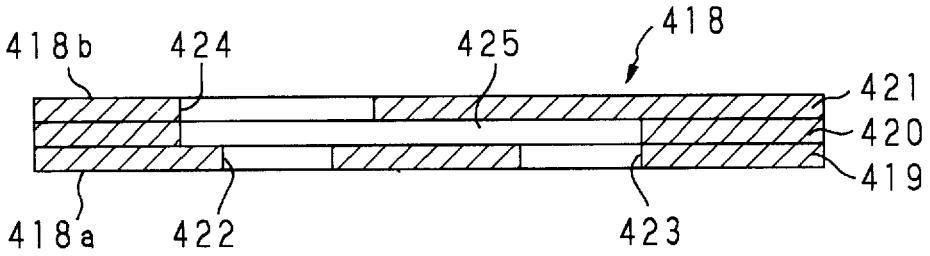
FIG.1 (PRIOR ART)
FIG. 1 is a sectional view of an orifice plate of the related art.

The structure of the nozzle portion used in the on-demand type printer apparatus previously proposed in JP Serial No. 5321246 by the assignee of the present application, that is, the orifice plate used for mixing the ink and a transparent solvent serving as the dilution liquid and discharging the same, is shown in FIG. 1, and the production process thereof is shown in FIG. 2.

An orifice plate 418 is formed by the lamination of three plates 419, 420, and 421. On one surface 418a of this orifice plate 418, two supply ports 422 and 423 to which for example the ink and a transparent solvent are supplied are provided. On the other surface 418b of the orifice plate 418 opposite to these supply ports 422 and 423, a nozzle 424 discharging a liquid mixture obtained by mixing these ink and transparent solvent is provided.

This nozzle 424 and one supply port 422 are disposed at opposite positions. Further, in the plate 420 disposed at the center, a flow path 425 connecting the supply ports 422 and 423 and the nozzle 424 is formed in the in-plane direction of this plate 420.

Figure 2A:
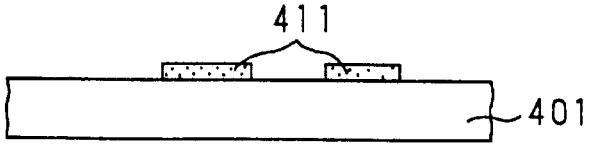
FIG.2A (PRIOR ART)
FIGS. 2A, 2B, 2C, 2D, 2E, 2F, 2G, and 2H are sectional views of the steps of manufacture of the orifice plate of the related art.

To produce this orifice plate 418, first, as shown in FIG. 2A, a photosensitive resist comprised by a dry film resist, a liquid resist, or the like is exposed and developed on a base material plate 401 of stainless steel or the like to obtain a resist pattern 411. This resist pattern 411 is formed at the position serving as the supply port.

Figure 2B:
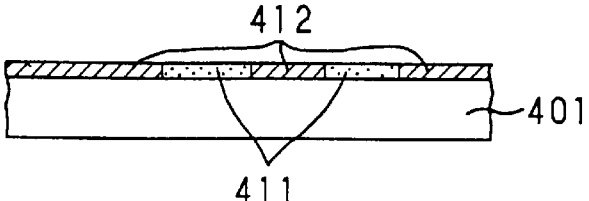
FIG.2B (PRIOR ART)
Figure 2C:
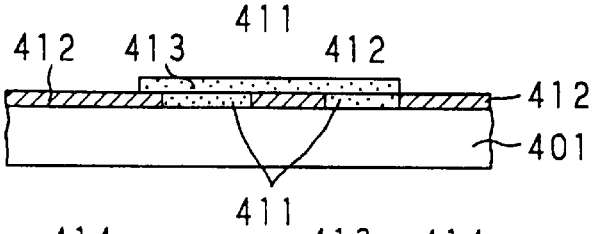
FIG.2C (PRIOR ART)

Next, as shown in FIG. 2B, nickel (Ni) is electroplated to the same thickness as that of the resist pattern 411 to obtain an Ni pattern 412. Then, as shown in FIG. 2C, a photosensitive resist comprised by a dry film resist, liquid resist, or the like is exposed and developed on this to obtain a resist pattern 413.

Figure 2D:
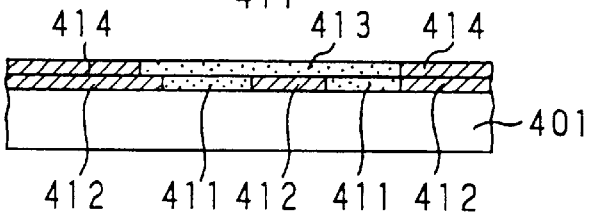
FIG.2D (PRIOR ART)
Figure 2E:
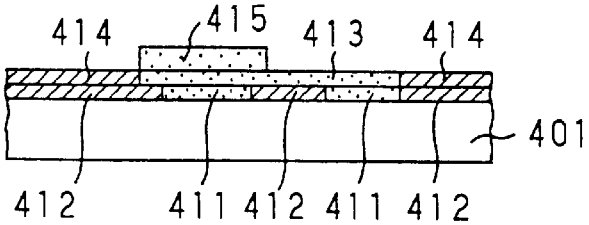
FIG.2E (PRIOR ART)

Further, similar to the step shown in FIG. 2D, Ni is electroplated to the same thickness as that of the resist to obtain an Ni pattern 414. Next, as shown in FIG. 2E, a photosensitive resist comprised by a dry film resist, a liquid resist, or the like is exposed and developed on this to obtain a resist pattern 415.

Figure 2F:
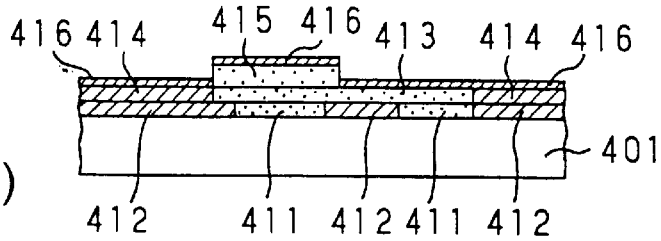
FIG.2F (PRIOR ART)
Figure 2G:
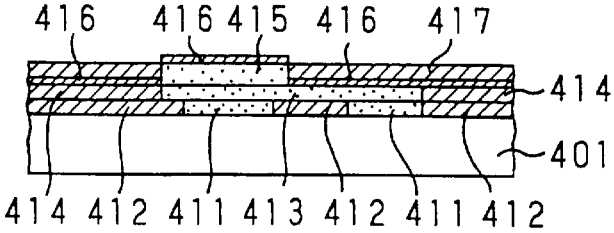
FIG.2G (PRIOR ART)

Then, as shown in FIG. 2F, on the resist pattern 415 and Ni pattern 414, an Ni film 416 is formed by sputtering or evaporation. Subsequently, as shown in FIG. 2G, Ni is electroplated to a thickness less than that of the resist pattern 415 to obtain an Ni pattern 417.

Figure 2H:
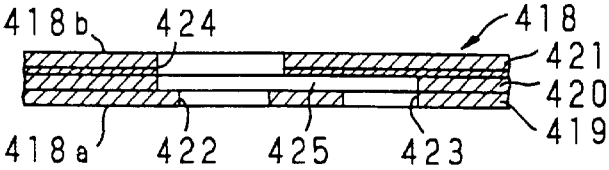
FIG.2H (PRIOR ART)

Finally, as shown in FIG. 2H, the resist pattern is removed by a resist pattern removing solution, for example, an aqueous KOH solution and the Ni is peeled from the base material plate 401 to obtain an orifice plate 418.

As explained above, however, this orifice plate 418 must be produced by sputtering or evaporation as explained in the production process shown in FIGS. 2A to 2H. That is, the orifice plate cannot be prepared only by a plating process and requires an expensive device such as a sputtering device.

Figure 3A:
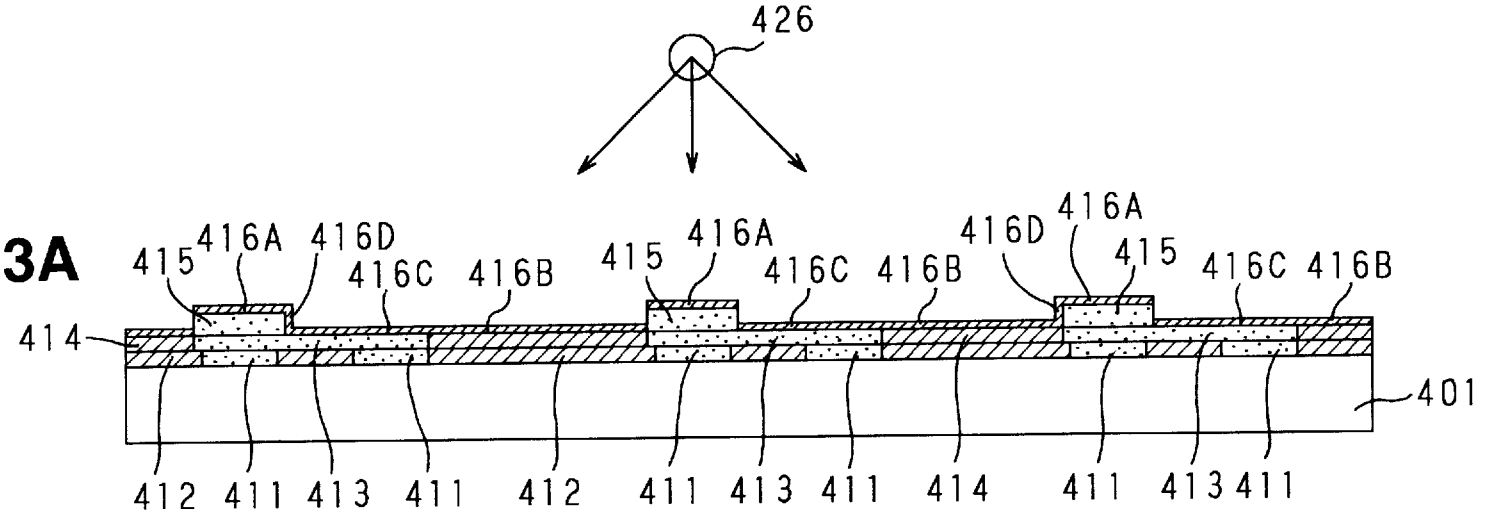
FIGS. 3A and 3B are enlarged sectional views of the steps for forming an Ni film by using a vacuum evaporation device.

Further, where the orifice plate 418 is produced by using a vacuum evaporation device, at the time of formation of the Ni film 416 shown in FIG. 3A, Ni particles sometimes fly from the evaporation source 426 and adhere to portions other than the portions to which they are originally supposed to deposit.

Namely, the Ni particles evaporated from the evaporation source 426 advance almost straight without changing direction midway. For this reason, in a region in which the evaporation source 426 does not line up with the direction of the normal line of the substrate, the Ni film 416D will also be formed on the side surfaces of the resist pattern 415.

The Ni film 416D formed on the side surfaces of this resist pattern 415 make it difficult to completely electrically isolate the Ni film 416A formed on an upper surface of the resist pattern 415 of the uppermost layer, the Ni film 416B formed on the Ni film 414 as the intermediate layer, and the Ni film 416C formed on the resist pattern 413 over a large surface area.

Figure 3B:
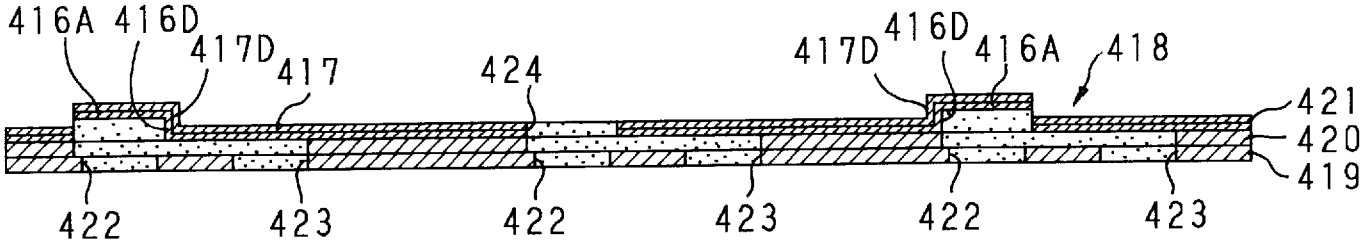

FIG. 3B shows the orifice plate 418 obtained by removing the resist pattern after evaporation and peeling off the Ni from the base material plate 401. From this figure, it is clear that in the region in which the Ni film 416D formed on the side surfaces of the resist pattern 415 of the uppermost layer exists, the Ni film 417D is deposited on this Ni film 416D in the next step and thereby creates a faulty portion.

The Ni film 417D formed on the side surfaces of this resist pattern 415 of the uppermost layer is made of Ni similar to the other portions, so it is difficult to chemically remove it. For this reason, the removal must be carried out only by a mechanical method such as polishing, which causes the above-mentioned problem of reduction of the manufacturing yield of the orifice plate 418.

So as not to cause the above faulty portion, the direction of the Ni particles flying from the evaporation source 426 must be aligned with the direction of the normal line of the resist pattern 415 without interruption. When doing this, there arise problems of enlargement of the size of the vacuum evaporation device, that is, the equipment becomes expensive, or of the reduction of size of the orifice plate to be prepared, that is, the enlargement of the aperture (lowering of cost), becoming impossible.

An example of use of the vacuum evaporation device was shown in FIGS. 3A and 3B. In a case of using sputtering as the method of forming the Ni film 416, the straight advance of the Ni particles is inferior to that in evaporation, so the faulty portion further spreads, which causes a further lowering of the manufacturing yield.

Below, a detailed explanation will be made of specific embodiments of the present invention by referring to the drawings.

First Embodiment

Figure 4:
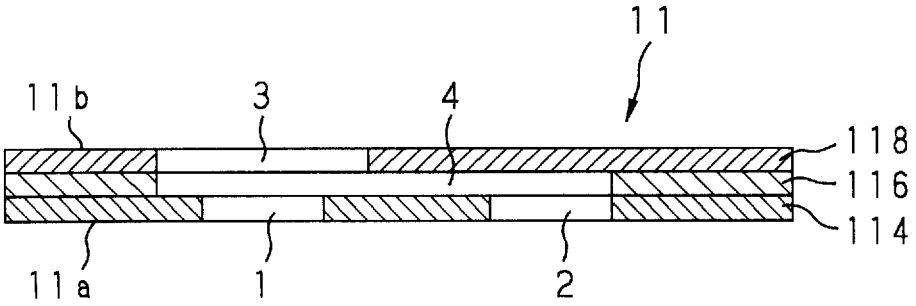
FIG. 4 is a sectional view of the structure of the orifice plate according to the present invention.

First of all, an explanation will be made of an embodiment of the orifice plate. An orifice plate 11 comprises a first plate 114, a second plate 118, and a third plate 116 as shown in FIG. 4 and is formed as a so-called laminated plate in which this third plate is sandwiched by the first plate 114 and the second plate 118 from the thickness direction.

On the first plate 114, in other words, on one surface 11*a* of the laminated plate, a plurality of supply ports 1 and 2 to which two or more types of different liquids are supplied are disposed. In this example, since two types of liquids are supplied, two supply ports 1 and 2 are disposed. Note that, where the number of types of liquids is three or more, the number of supply ports 1 and 2 is increased to three or more in accordance with the types of the liquids.

The ink is supplied to at least one of these supply ports 1 and 2. In this example, a transparent solvent serving as the dilution liquid is supplied to one supply port 1, and the ink is supplied to the other supply port 2. The supply ports 1 and 2 are formed on the first plate 114 as circular through-holes as shown in the flat plane view of the orifice plate in FIG. 5 seen from the surface 11*b* opposite to the surface 11*a* on which the supply ports 1 and 2 are disposed. Note that, such supply ports 1 and 2 do not always have to be circular through-holes and may be for example elliptical or rectangular.

On the second plate 118, in other words, on the other surface 11*b* of the laminated plate, a nozzle 3 for discharging a liquid mixture obtained by mixing two or more types of liquids is formed. Such a nozzle 3 is disposed at a position opposite to one supply port 1 and is formed as a circular through-hole having a larger opening diameter than the opening diameter of the supply port 1. Note that, the nozzle 3 desirably has a larger opening diameter than the opening diameter of the supply port 1 as described above, but can be the same as the opening diameter of the supply port 1 too. Further, the nozzle 3 does not have to be a circular through-hole the same as the supply ports 1 and 2. There is no problem even if it is elliptical or rectangular.

The third plate 116 is disposed between the first plate 114 and the second plate 118. This third plate 116 comprises a dry film resist and has a flow path 4 in the in-plane direction of the plate. This flow path 4 is connected to the supply ports 1 and 2 and, at the same time, also connected to the nozzle 3. Further, this flow path 4 is given a taper shape where the width thereof becomes narrower from the supply port 2 not facing the nozzle 3 toward the nozzle 3. Note that, there is no problem even if the flow path 4 is straight in shape.

Second Embodiment

Figure 6A:
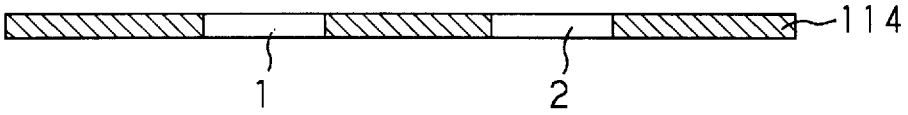
FIGS. 6A, 6B, and 6C are sectional views sequentially showing the steps of manufacturing the orifice plate according to the present invention.

Next, an explanation will be made of the method of production of the orifice plate 11 having the above structure. First, the first plate 114 on which the supply ports 1 and 2 are formed is prepared by for example electroplating of Ni as shown in FIG. 6A. The supply ports 1 and 2 are formed as for example circular through-holes at a predetermined interval.

Figure 6B:
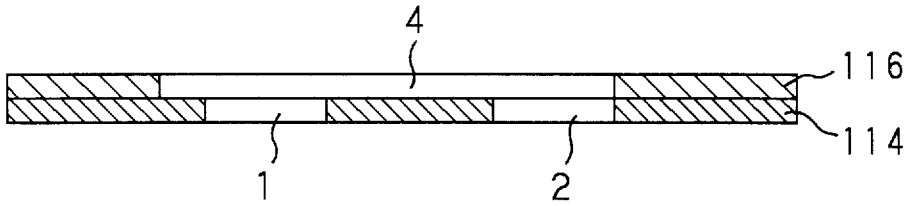

Next, as shown in FIG. 6B, a dry film resist for a permanent mask is thermally laminated on this first plate 114 at about 110° C. Then, in order to form the flow path 4 having the previously explained shape on this dry film resist, the resist is exposed and developed. As a result, the flow path 4 is formed in the in-plane direction of the third plate 116 made of this dry film resist.

Figure 6C:
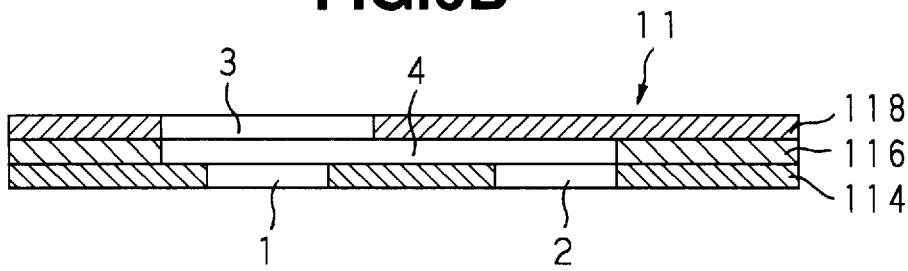

Subsequently, as shown in FIG. 6C, the second plate 118 on which the nozzle 3 prepared by for example the electroplating of Ni is formed is laminated together with the first plate 114 so as to sandwich the third plate 116 from the thickness direction thereof. At the lamination of this second plate 118, the nozzle 3 is positioned so as to face one supply port 1 when adhering the plates to each other.

Finally, heat treatment (post-heat treatment) of about 30 minutes is carried out at 150° C., the dry film resist is cured, and then the orifice plate 11 is completed.

Note that, in the above production process, Ni was used as the material constituting the first plate 114 and the second plate 118, but the material is not particularly limited to Ni. For example, the same material does not have to be used as the first plate 114 and the second plate 118; it is also possible to use a metal such as Cu where the laminated plate is prepared by the electroplating method etc. Further, an inorganic material such as glass or Si and an organic material such as a polyimide can be used. On the other hand, the method of production of the first plate 114 and the second plate 118 is not limited to the electroplating method. For example, any hole-making method using for example etching or a laser or an extrusion method etc. can be adopted so far as the formation of the supply ports 1 and 2 and the nozzle 3 is possible.

Note, the first plate 114 and the second plate 118 must be able to withstand the temperature at the thermal lamination and post-heat treatment of the dry film resist (about 150° C.). Further, it is necessary that these first plate 114 and the second plate 118 have sufficient rigidity so that they will not fall into the flow path 4 and close the flow path 4.

Figure 7:
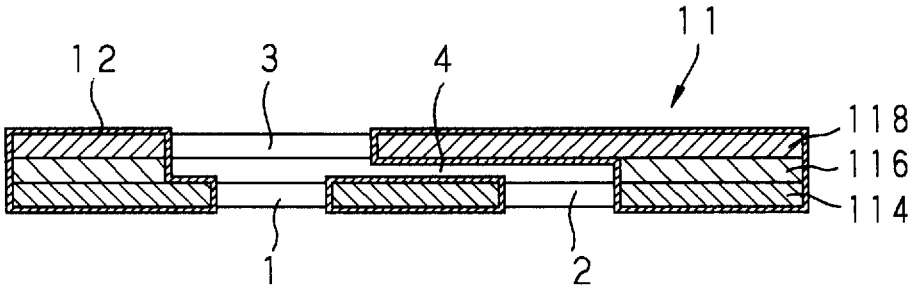
FIG. 7 is a sectional view of the orifice plate comprised of the orifice plate shown in FIG. 1 over the entire surface of which a protective film is formed.

In the orifice plate 11 having the above structure, to enhance the chemical stability with respect to the liquid, as shown in FIG. 7, it is also possible to form a protective film 12 on the entire surface of the orifice plate 11 or in the portions in contact with the liquid. More specifically, by dipping the orifice plate 11 in an electroless plating liquid of for example Au, a protective film 12 made of Au is formed on the entire surface of the orifice plate 11. By the formation of such a protective film 12, the chemical stability of the orifice plate 11 is enhanced.

Third Embodiment

Figure 8:
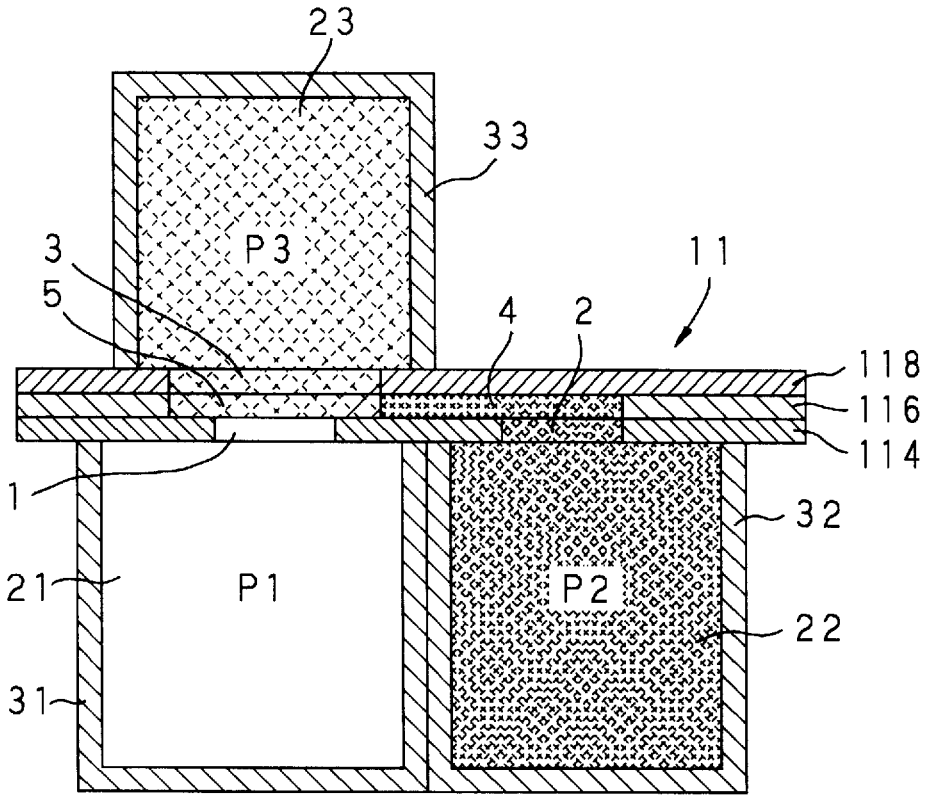
FIG. 8 is a sectional view of the structure of a liquid mixing apparatus according to the present invention.

Next, an embodiment of a liquid mixing apparatus will be explained in detail by referring to FIG. 8.

The liquid mixing apparatus is constituted by an orifice plate 11 shown in FIG. 4, a first tank 31 and a second tank 32 serving as liquid vessels connected to the supply ports 1 and 2 of this orifice plate 11 and filled with the liquids, and a third tank 33 serving as the liquid mixture vessel connected to the nozzle 3 and accommodating the liquid mixture 23 obtained by mixing two or more types of liquids.

The first tank 31 is connected to the supply port 1 disposed opposite to the nozzle 3. In this first tank 31, a first liquid 21 different from the liquid filled in the second tank 32 is filled.

On the other hand, the second tank 32 is connected to the other supply port 2. In this second tank 32, the second liquid 22 is filled.

The third tank 33 is connected to the nozzle 3. In this third tank 33, a liquid mixture 23 obtained by mixing the first liquid 21 and the second liquid 22 is filled discharged from the nozzle 3.

In this liquid mixing apparatus, where the pressures in the tanks 31, 32, and 33 are P1, P2, and P3, respectively (note, it is assumed that P1>P3and P2>P3), the first liquid 21 fed from one supply port 1 into the orifice plate 11 and the second liquid 22 fed from the other supply port 2 into the orifice plate 11 and passing through the flow path 4 are mixed in the mixing chamber 5. Then, the liquid mixture 23 is discharged to the third tank 33 from the nozzle 3.

Here, the mixing ratio of the liquid mixture 23 and the flow rate of the mixing liquids 21 and 22 can be changed according to the viscosities of the liquids 21 and 22, the pressures P1, P2, and P3 in the tanks, and further the flow path resistance of the supply ports 1 and 2, the flow path 4, and the mixing chamber 5. In this orifice plate 11, the arrangement of the nozzle 3 opposite to either of the supply port 1 or 2 is simple in structure and so it becomes to easy to lower the flow path resistance. Further, desirably a liquid having a higher mixing ratio between the two or more types of liquids 21 and 22 to be mixed is filled in the first tank 31 opposite to the nozzle 3.

Further, with the orifice plate 11 used in this liquid mixing apparatus, as understood also from the production process shown in FIGS. 6A to 6C, the reduction of thickness of the orifice plate 11 is easy, and so it is also easy to reduce the dimensions of the supply ports 1 and 2 and the nozzle 3. For this reason, a liquid mixing apparatus which can be used in a tiny area in which it could not be conventionally arranged can be provided.

Further, it is sufficient so far as the thickness of this orifice plate 11 is a thickness by which it can withstand the pressure difference between the first tank 31 or the second tank 32 and the third tank 33 (P1−P3or P2−P3) and the flow path resistance. There is no problem even if the thickness is set to 0.2 mm or 0.1 mm or less. Accordingly, an extremely thin liquid mixing apparatus which does not conventionally exist can be obtained.

Figure 9:
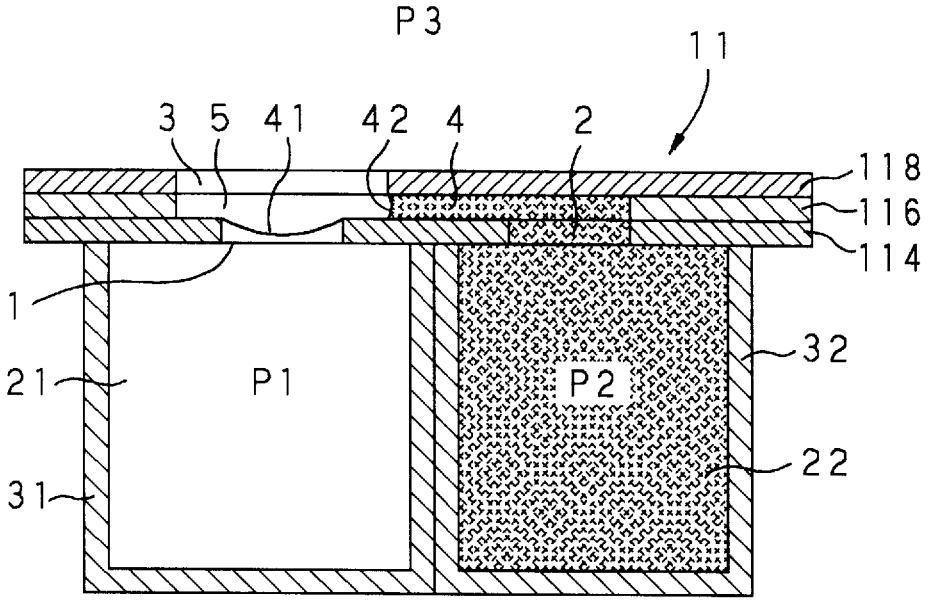
FIG. 9 is a sectional view of the structure of the liquid mixing apparatus from which the tank disposed on the nozzle side is removed.

Next, an explanation will be made of an example in which the third tank 33 connected to the nozzle 3 is removed and the surface of the nozzle 3 side is opened to the gas by referring to FIG. 9.

For example, assume that the pressures of the first tank 31 and the second tank 32 are P1 and P2, respectively, and the atmospheric pressure on the nozzle 3 side is P3. Then, in a state where pressure is not applied to P1 and P2, that is, P1=P2=P3, the first liquid 21 fed from the supply port 1 into the orifice plate 11 and the second liquid 22 fed from the supply port 2 into the orifice plate 11 respectively form meniscuses at the positions where the respective surface tensions are well balanced and exhibit a stationary state.

Figure 5:
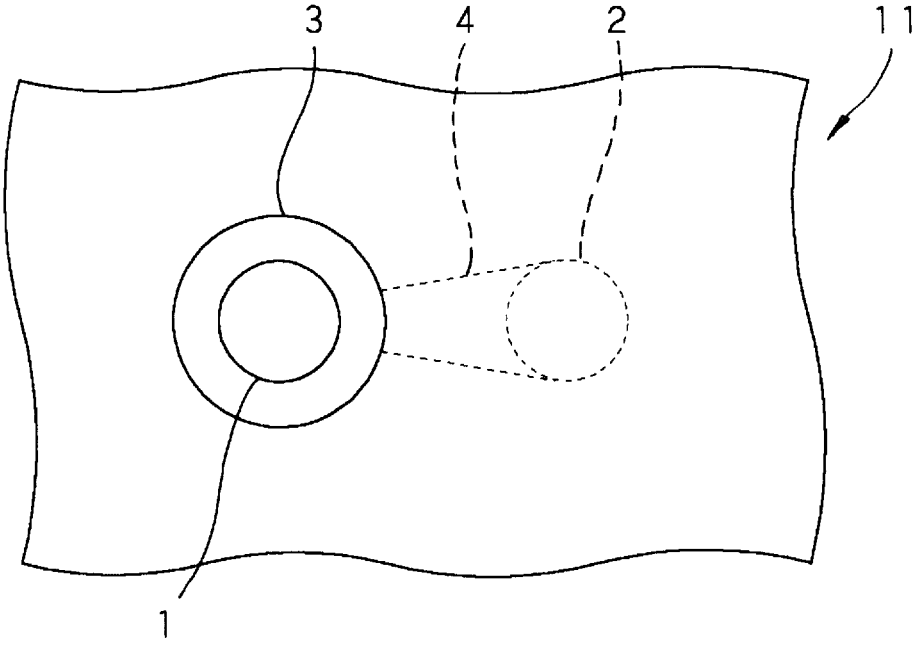
FIG. 5 is a plan view of a state of the orifice plate according to the present invention seen from the nozzle side.
Figure 10:
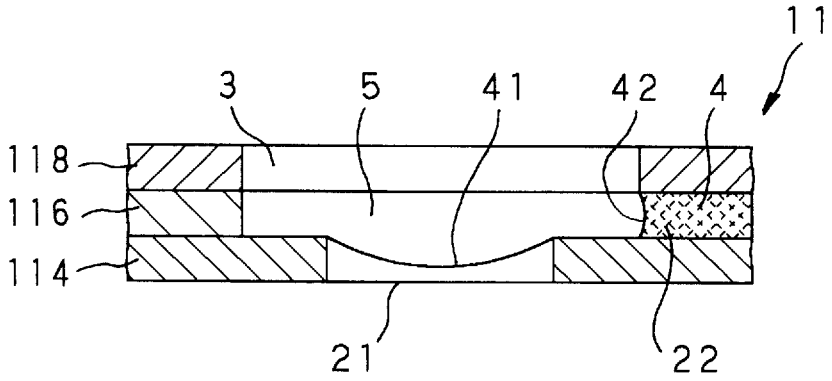
FIG. 10 is an enlarged sectional view of principal parts showing the meniscus-forming portion of the liquid mixing apparatus of FIG. 6.

Note that, the position where the meniscus is formed, for example, the position of the meniscus 41 in the first liquid 21 and the position of the meniscus 42 in the second liquid 22, is given by the shape of the flow path. Namely, in a case where an orifice plate 11 having a shape shown in FIG. 5 is used, the positions of the meniscuses 41 and 42 shown in the enlarged view of FIG. 10 are given.

Further, in the vicinity of the flow path 4 and the mixing chamber 5 in which at least the mixing is carried out, where volatile treatment is carried out, these liquids 21 and 22 more stably form meniscuses 41 and 42 on the supply port 1 side than the portion in which the mixing is carried out and can exhibit a stationary state.

Next, an explanation will be made of a case where the pressures P1 and P2 in the first tank 31 and the second tank 32 are alternately raised. First, an explanation is given of the operation in a case where the pressure P1 in the first tank 31 is temporarily raised after the pressure P2 in the second tank 32 is temporarily raised.

Figure 11A:
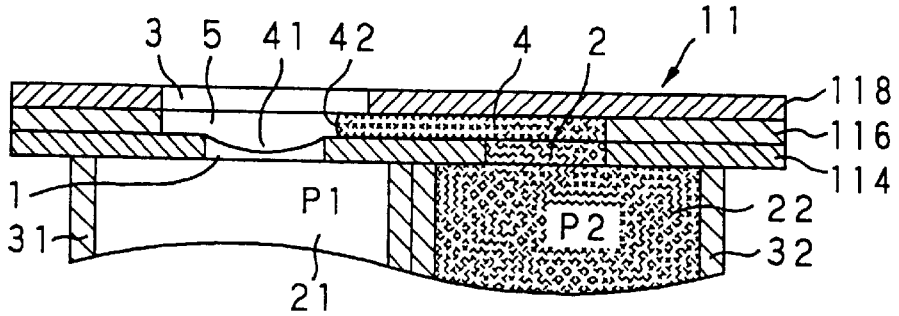
FIGS. 11A, 11B, 11C, 11D, and 11E are sectional views showing the liquid mixture discharging operation in the liquid mixing apparatus of FIG. 6.

When the pressure P2 in the second tank 32 is temporarily raised, as shown in FIG. 11A, the meniscus 42 of the second liquid 22 will move by the rising of the pressure P2 of the second tank 32. Namely, the meniscus 42 moves to the mixing chamber 5 side.

Figure 11B:
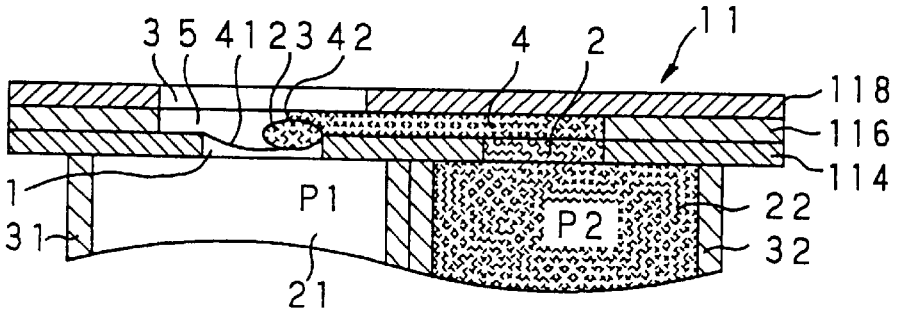

Here, as shown in FIG. 11B, by adjusting the rising amount and rising time of the pressure, the meniscus 42 comes into contact with the meniscus 41 of the first liquid 21 in the mixing chamber 5. That is, in the vicinity of the mixing chamber 5, the first liquid 21 and the second liquid 22 are mixed and the liquid mixture 23 is generated.

Figure 11C:
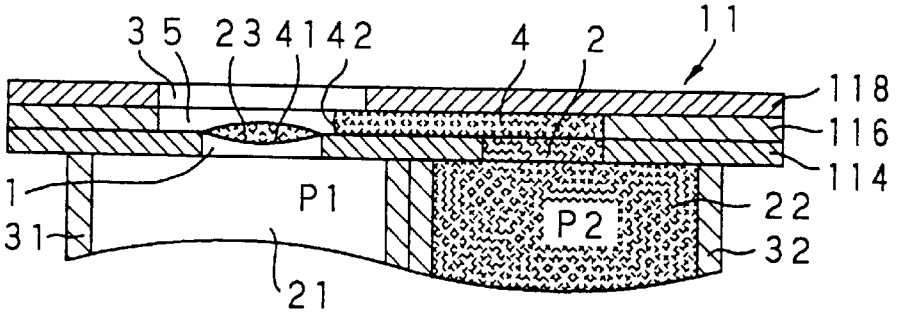

Next, the pressure P2 in the second tank 32 is returned to the ambient atmospheric pressure P3 . Then, the meniscus 42 formed in the flow path 4 is stable when it exists at a position not in contact with the other meniscus 41, so it will retract to the supply port 2 side connected to the second tank 32. Here, the first liquid 21 and the second liquid 22 which contacted in Fig. 11B are separated, and as shown in FIG. 11C, the meniscus 42 will be newly generated.

Figure 11D:
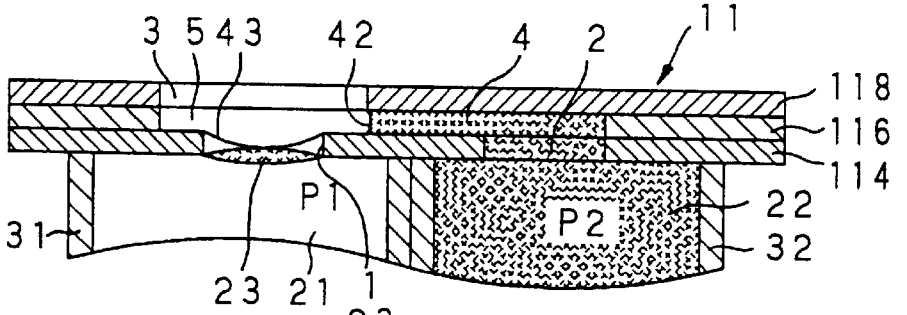

Then, as shown in FIG. 11D, the meniscus 42 of the second liquid 22 which is newly generated moves to a stable position where the rising of the pressure P2 in the second tank 32 does not occur. Then, in the vicinity of the mixing chamber 5, the mixed liquid mixture 23 will form the meniscus 43.

Note that, here, by further increasing the rising amount and rising time of the pressure P2 of the second liquid 22, the mixing ratio of the second liquid 22 contained in the liquid mixture 23 can be raised. That is, the mixing ratio of the liquid mixture 23 to be generated is adjusted by the rising amount and rising time of the pressure P2 in the second tank 32.

Figure 11E:
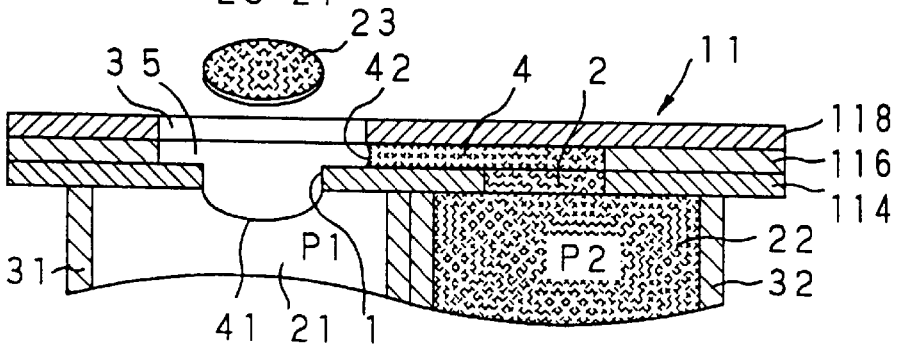

Next, the pressure P1 in the first tank 31 is temporarily raised. Then, the meniscus 43 will move toward the interior of the mixing chamber 5. Here, when the pressure P1 in the first tank 31 is increased, the liquid mixture 23 is discharged from the nozzle 3 as shown in Fig. 11E. Then, a new meniscus 41 is generated in the first liquid 21.

That is, by the above step, the first liquid 21 and the second liquid 22 are mixed in the mixing chamber 5 and then become the liquid mixture 23 which will be discharged into the atmosphere from the nozzle 3. Note that, the timing of temporarily raising the pressure P1 in the first tank 31 must be before a time when the mutual diffusion of the liquid mixture 23 and the first liquid 21 is excessively advanced.

Note that, in the liquid mixing apparatus of this example, two supply ports 1 and 2 and one nozzle 3 are disposed, but it is also possible to arrange a plurality of pairs of the supply ports 1 and 2 and the nozzle 3 in such an orifice plate 11.

Fourth Embodiment

Next, an explanation will be made of an embodiment of a so-called on-demand type printer apparatus by referring to the figures. Here, an explanation is made of a so-called a carrier jet type printer apparatus in which the ink is disposed on the quantitative side, the dilution liquid is disposed on the discharge side, and the liquid mixture obtained by mixing them is discharged onto the recording sheet.

Figure 12:
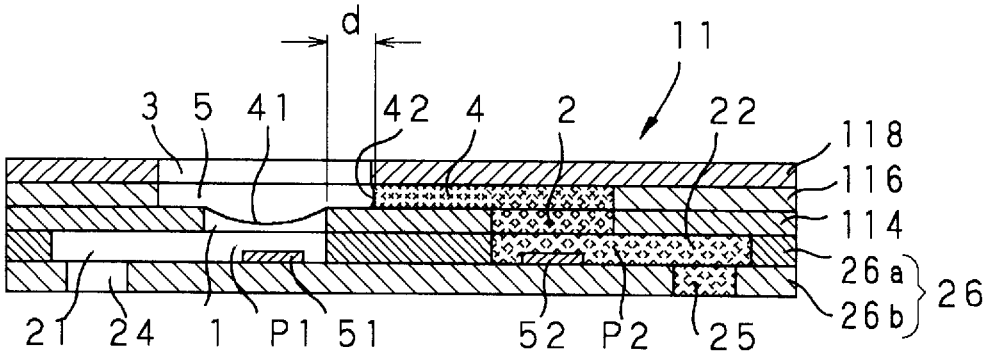
FIG. 12 is a sectional view of a printer apparatus according to the present invention.

In this carrier jet type printer apparatus, as shown in FIG. 12, an orifice plate 11 shown in FIG. 4 explained in the previous first embodiment and pressure raising means 51 and 52 disposed in the vicinity of the supply ports 1 and 2 of this orifice plate 11 are provided. The pressures of the liquids 21 and 22 in the vicinity of the supply ports 1 and 2 are raised by these pressure raising means 51 and 52, whereby the liquid mixture 23 is discharged from the nozzle 3 and deposited on the recording medium.

The pressure raising means 51 and 52 are for raising the pressures of the liquids 21 and 21 in the vicinity of the supply ports 1 and 2 and are disposed in the vicinity of the supply ports 1 and 2. These pressure raising means 51 and 52 are included in the laminated plate 26 disposed on the main surface 11*a* of the orifice plate 11 on which the supply ports 1 and 2 are disposed.

The laminated plate 26 is obtained by superimposing two plates 26*a* and 26*b* on each other and has flow paths 24 and 25 connected to the respective supply ports 1 and 2. In the flow paths 24 and 25 thereof, the pressure raising means 51 and 52 are disposed at the vicinity opposite to the respective supply ports 1 and 2. These pressure raising means 51 and 52 are disposed on one plate 26*b*. Note that, the plate 26*b* on which the pressure raising means 51 and 52 are disposed is formed by a dry film resist.

As the pressure raising means 51 and 52, any means can be used so far as it can raise the pressures of the liquids 21 and 22 in the vicinity of the supply ports 1 and 2. For example a heater or a piezoelectric element such as a piezo element can be used. In this example, a heater was used. The operation of the printer apparatus having the above structure is as follows. Note that, a transparent solvent is used as the first liquid 21 and an ink is used as the second liquid 22.

Figure 13A:
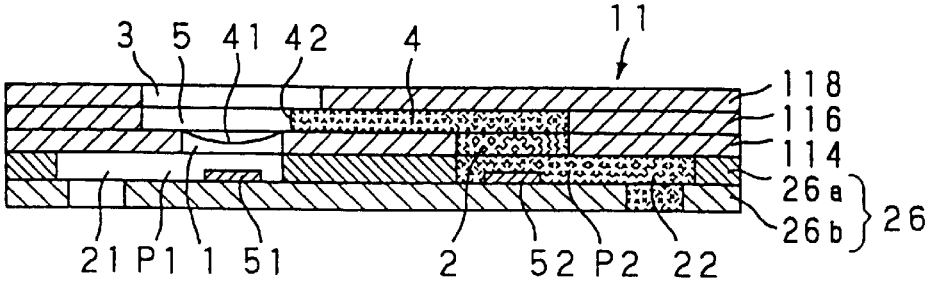
FIGS. 13A, 13B, 13C, 13D, and 13E are sectional views showing the liquid mixture discharging operation in the printer apparatus according to the present invention.
Figure 13B:
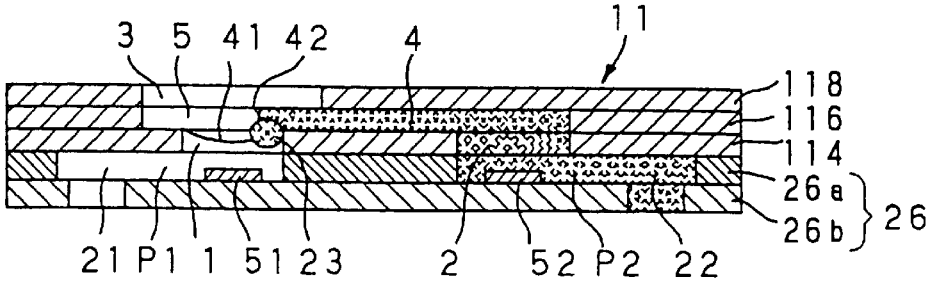

First, in FIG. 13A, a signal is given to the pressure raising means 52 disposed in the vicinity of the supply port 2 to which the second liquid 22 is supplied so as to boil the second liquid 22 and raise the pressure P2 in the vicinity of the supply port 2. As a result, the meniscus 42 of the second liquid 22 moves to the mixing chamber 5 side.

Then, by adjusting the rising amount and rising time of the pressure P2, the meniscus 42 will come into contact with the meniscus 41 of the first liquid 21 in the mixing chamber 5 as shown in 13B. As a result, in the vicinity of the mixing chamber 5, a liquid mixture 23 obtained by mixing the first liquid 21 and the second liquid 22 will be generated.

Figure 13C:
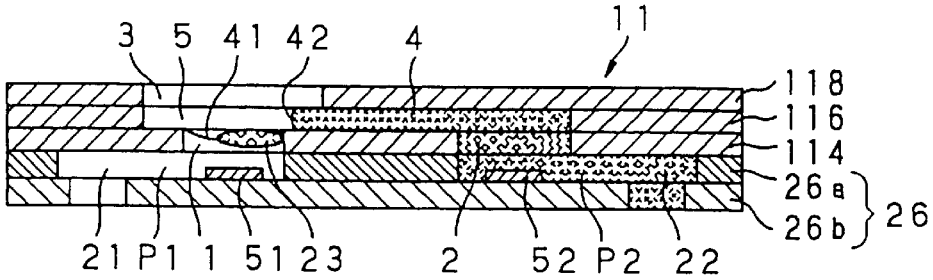
Figure 13D:
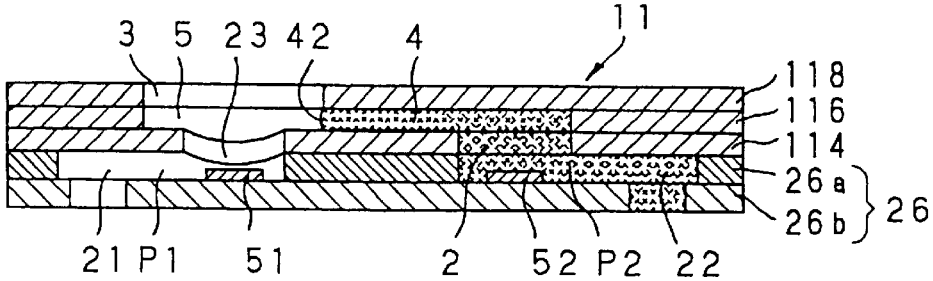

Next, the signal sent to the pressure raising means 52 disposed in the vicinity of the supply port 2 of the second liquid 22 is returned to its original value. Then, in a case where no pressure rise occurs on the supply port 2 side of the second liquid 22, the meniscus 42 of the second liquid 22 is stable when existing at the position not in contact with the meniscus 41 of the first liquid 21. Therefore, as shown in FIG. 13C, it retracts to the supply port 2 side of this second liquid 22 and separates from the first liquid 21. Then, in the vicinity of the mixing chamber 5, as shown in FIG. 13D, a liquid mixture 23 having an intermediate density is formed.

Note that, here, the rising amount and rising time of the pressure P2 of the second liquid 22, that is, the signal to be given to the pressure raising means 52, may be further increased to raise the mixing ratio of the second liquid 22 contained in the liquid mixture 23, that is, the ink concentration. That is, the mixing ratio of the liquid mixture 23 to be generated (ink concentration) is adjusted by the rising amount and rising time of the pressure P2, that is. the signal to be given to the pressure raising means 52.

Figure 13E:
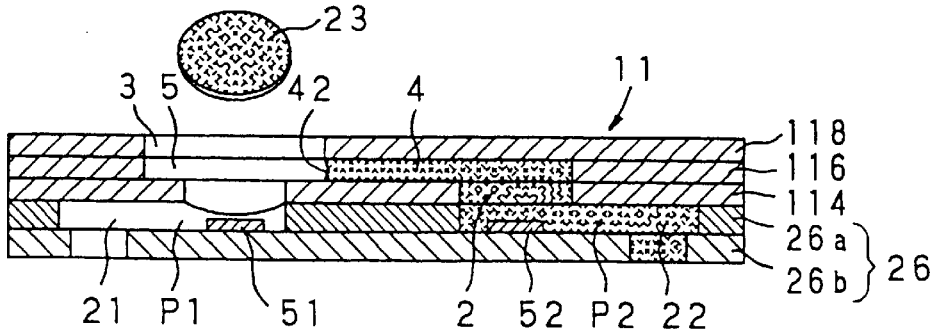

Next, a signal is given to the pressure raising means 51 disposed in the vicinity of the supply port 1 to which the first liquid 21 is supplied, thereby to boil the first liquid 21 and to temporarily raise the pressure P1 in the vicinity of the supply port 1. Then, the liquid mixture 23 will move toward the mixing chamber 5 side. Here, when the pressure P1 of the first liquid 21 is increased, as shown in FIG. 13E, the liquid mixture 23 is discharged into the atmosphere from the nozzle 3 and deposited on the recording sheet (illustration is omitted) used as the recording medium disposed opposite to this nozzle 3. On the other hand, a new meniscus 41 will be generated at the supply port 21 to which the first liquid 21 is supplied.

Here, the timing of giving the signal to the pressure raising means 51 disposed in the vicinity of the supply port 1 to which the first liquid 21 is supplied must be before a time when the diffusion of the liquid mixture 23 and the first liquid 21 is excessively advanced.

In an on-demand type printer apparatus constituted in this way, by adjusting the rising amount and rising time of the pressure P2 of the second liquid 22 made the ink, that is, the signal to be given to the pressure raising means 52, the mixing ratio of the second liquid 22 contained in the liquid mixture 23, that is, the ink concentration, can be adjusted, so it becomes possible to express gradations which had never been achieved in a conventional on-demand printer apparatus.

Note that, in this printer apparatus, the following processing is preferably carried out so as to further improve the printing performance.

First, the thickness of the orifice plate 11 is set to 0.2 mm or less, more preferably set to 0.1 mm or less. This is because, when the thickness of the orifice plate 11 exceeds 0.2 mm, the printing performance is degraded.

Second, the opening area S1 of the portion (discharge side) in which the meniscus is formed in the supply port 1 to which the first liquid 21 is supplied shown in FIG. 13 is defined as $50<S1<40000\ \mu m^2$. Preferably, it is defined as $100<S1<10000\ \mu m^2$. The upper limit of this numerical value is determined according to whether or not the printing of image can be carried out by the lowest resolution required as the printer (about 75 dpi in a case of 40000 $\mu m^2$ and about 200 dpi in a case of 10000 $\mu m^2$). Accordingly, if it exceeds 40000 $\mu m^2$, it becomes impossible to perform the image printing with the lowest resolution which is required. On the other hand, the lower limit is determined according to whether or not the discharge can be carried out. Here, if it becomes less than 50 $\mu m^2$, it becomes impossible to discharge the liquid mixture.

On the other hand, the opening area S2 of the portion (quantitative side) in which the meniscus of the second liquid 22 is formed is defined as $5/10000<S2/S1<10$. When it exceeds 10, ink is spread around the orifice, and the precision becomes poor. Contrary to this, when it is less than $5/10000$, the amount which can be quantitated at one time becomes too small. Further, so as to achieve a high precision quantitation of ink, the opening area S2 is defined as $5/10000<S2/S1<5$. Further, for a high precision single inking operation, it is determined as $1/100<S2/S1<5$. Further, so as to lower the lowest density of the recording dot, it is determined as $1/100<S2/S1<1/2$.

Third, as the on-demand type printer apparatus, where an orifice plate 11 of the present invention is used, where no rise occurs in the pressure of the supply ports of the liquids, the two or more types of liquids form the meniscus with which the energy of the surface tension becomes the minimum on the supply port side from the flow path in which they are respectively mixed and exhibit a stationary state. In such a case, the shortest distance d indicated in FIG. 12 on the discharge side and quantitative side is preferably defined as $1/10/S1<d<5/S1$. When the shortest distance d exceeds 5/S1, the response of the quantitative ink becomes bad, and conversely, if it is less than 1/10/S1, natural mixing becomes easy.

Other than this, in a case where a plurality of pairs of the supply ports 1 and 2 and the nozzle 3 are arranged in the orifice plate 11, the interval between centers of the pairs of meniscuses is desirably smaller than the distance between centers of the other pairs of meniscuses.

Note that, in this fourth embodiment, a printer apparatus of the carrier jet system was used as an example, but it is also possible to apply the present invention to a so-called ink jet type printer apparatus in which the dilution liquid is disposed on the quantitative side and the ink is disposed on the discharge side and a liquid mixture obtained by mixing them is discharged.

Fifth Embodiment

Figure 14:
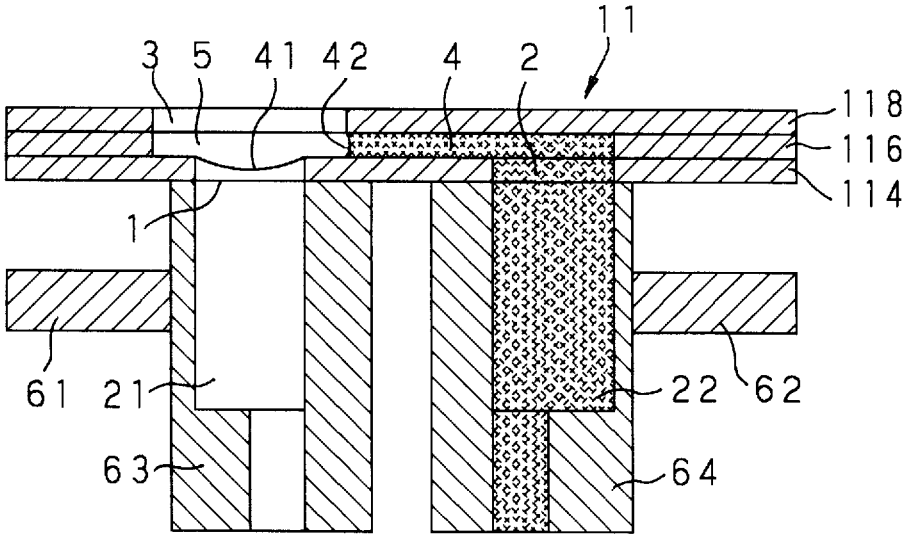
FIG. 14 is a sectional view of a printer apparatus using a piezoelectric element as a pressure raising means.

Next, an example of a printer apparatus using the piezoelectric elements 61 and 62 such as piezo elements as the pressure raising means 51 and 52 will be shown in FIG. 14.

The piezoelectric elements 61 and 62 are disposed in the liquid vessel 63 in which the first liquid 21 which is the dilution liquid is filled and the liquid vessel 64 in which the second liquid 22 serving as the ink is filled, these vessels being connected to the supply ports 1 and 2, respectively. Such piezoelectric elements 61 and 62 are deformed by the signal supplied to the piezoelectric elements 61 and 62 and change the pressures P1 and P2 in the liquid vessels 63 and 64 by the pressure at the time of the deformation.

In the printer apparatus using these piezoelectric elements 61 and 62, similar to one using the heater as well, by adjusting the signal to be given to the piezoelectric elements 61 and 62, the mixing ratio of the second liquid 22 contained in the liquid mixture 23, that is, the ink concentration, can be adjusted.

Note that, here, the piezoelectric elements 61 and 62 were used as the pressure raising means 51 and 52, but it is also possible to combine and use a heater with these piezoelectric elements 61 and 62.

According to the present invention, a plate on which the supply ports are formed and a plate on which a nozzle is formed are adhered to each other via a dry film resist to laminate them, so even if a vacuum thin film forming apparatus such as an evaporation device is not used, an inexpensive orifice plate having a high precision and large aperture can be provided with a good manufacturing yield. For this reason, a great reduction of cost of the orifice plate can be realized.

Further, since it is a simple method of adhering two plates to each other sandwiching between them the dry film resist, use of a wide range of materials becomes possible as the material constituting the orifice plate.

Further, the orifice plate of the present invention can easily reduce the thickness of the orifice plate per se and can easily reduce also the dimensions of the supply port and the nozzle.

If such an orifice plate is used in a liquid mixing apparatus, it can be used in a small region in which it conventionally could not be arranged.

Further, by using this orifice plate in the printer apparatus, expression of gradations which has not been possible in the conventional on-demand type printer apparatus can be carried out, and a reduction of the costs of the printer apparatus is realized.

What is claimed is:

1. An orifice plate wherein a plurality of supply ports to which two or more types of different liquids are supplied are disposed in a first plate of a laminated structure comprising three plates laminated to each other and a nozzle for discharging a liquid mixture obtained by mixing two or more types of liquids is disposed in a second plate, wherein a plate disposed at an intermediate level between the first and second plates is made exclusively of a single photosensitive resin.

2. An orifice plate as set forth in claim 1, wherein the flow path disposed in the intermediate plate is connected to the supply ports and the nozzle.

3. An orifice plate as set forth in claim 1, wherein at least one supply port among a plurality of supply ports is disposed at a position opposite to the nozzle.

4. An orifice plate as set forth in claim 1, wherein one or more types among two or more types of liquids are ink.

5. An orifice plate as set forth in claim 1, wherein one or more types among two or more types of liquids are ink and another type is a dilution liquid.

6. A method of producing an orifice plate comprising the steps providing a first plate in which a plurality of supply ports are formed to which two or more types of different liquids are supplied;

providing a second plate having a nozzle opposite to at least one supply port among the plurality of supply ports ;and providing a third plate made of a single photosensitive resin layer located directly adjacent the first and second plates to form a flow path connected to the supply ports and the nozzle.

7. A liquid mixing apparatus comprising:

an orifice plate in which a plurality of supply ports to which two or more types of different liquids are supplied are disposed wherein the orifice plate is one plate of a laminated structure formed by lamination of three plates and a nozzle is disposed in another plate which is located on a side of an intermediate plate opposite to a side of the intermediate layer on which the orifice plate is formed and wherein the intermediate plate is made exclusively of a single photosensitive resin layer;

at least one liquid vessel connected to supply port; and a liquid mixture vessel which is connected to the nozzle and in which the liquid mixture obtained by mixing two or more types of liquids is accommodated.

8. A liquid mixing apparatus as set forth in claim 7, wherein at least one supply port among the plurality of supply ports is disposed at a position opposite to the nozzle.

9. A liquid mixing apparatus as set forth in claim 7, wherein at least one or more types among two or more types of liquids are ink.

10. A liquid mixing apparatus as set forth in claim 7, wherein one or more types among two or more types of liquids are ink, and the other one or more types are dilution liquids.

11. A printer apparatus comprising:

an orifice plate in which a plurality of supply ports to which two or more types of different liquids are supplied are disposed in one plate of laminated structure formed by lamination of three plates and a nozzle disposed is disposed in another plate which is on a side of an intermediate plate which is opposite a side of the intermediate plate on which the orifice plate is mounted and further wherein the intermediate plate is made of a single photosensitive resin resin;

a pressure raising means which is disposed in the vicinity of the respective supply ports for raising liquid in the supply port vicinities; and a recording head which raises the pressure of the liquid in the supply port vicinities by this pressure raising means, discharges the liquid mixture from the nozzle, and deposit this to the recording medium.

12. A printer apparatus as set forth in claim 11, wherein at least one supply port among the plurality of supply ports is disposed at a position opposite to the nozzle.

13. A printer apparatus as set forth in claim 11, wherein one or more types among two or more types of liquids are ink, and the other one or more types are a dilution liquid.

14. A printer apparatus as set forth in claim 11, wherein the pressure raising means is a heater.

15. A printer apparatus as set forth in claim 11, wherein the pressure raising means is a piezoelectric element.

* * * * *